US006543253B1

(12) United States Patent
Schaub et al.

(10) Patent No.: US 6,543,253 B1
(45) Date of Patent: Apr. 8, 2003

(54) METHOD FOR PROVIDING REFRIGERATION TO A CRYOGENIC RECTIFICATION PLANT

(75) Inventors: Herbert Raymond Schaub, East Amherst, NY (US); Todd Alan Skare, Elma, NY (US); Thomas John Bergman, Jr., Clarence Center, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 10/153,663

(22) Filed: May 24, 2002

(51) Int. Cl.[7] ..... F25J 3/00
(52) U.S. Cl. ..... 62/643; 62/646; 62/912
(58) Field of Search ..... 62/643, 646, 644, 62/912

(56) References Cited

U.S. PATENT DOCUMENTS 4,152,130 A * 5/1979 Theobald ..... 62/646
5,275,003 A * 1/1994 Agrawal et al. ..... 62/646
5,287,704 A 2/1994 Rathbone ..... 62/25
5,582,033 A 12/1996 Bonaquist et al. ..... 62/643
5,600,970 A 2/1997 Drnevich et al. ..... 62/651
5,651,271 A 7/1997 Fraysse et al. ..... 62/646
5,655,388 A 8/1997 Bonaquist et al. ..... 62/651
5,678,425 A * 10/1997 Agrawal et al. ..... 62/646
5,758,515 A 6/1998 Howard ..... 62/646
6,112,550 A 9/2000 Bonaquist et al. ..... 62/646
6,257,020 B1 * 7/2001 Tranier ..... 62/646

* cited by examiner

*Primary Examiner*—William C. Doerrler
(74) *Attorney, Agent, or Firm*—Stanley Ktorides

(57) ABSTRACT

A method for providing refrigeration to a cryogenic rectification plant which enables the facile provision of varying amounts of refrigeration to the plant wherein a working fluid is pressurized in a recycle compressor, a first portion is at least partially condensed in a heat exchanger and passed into the plant, a second portion is cooled and then turboexpanded to generate refrigeration, the refrigeration bearing second portion passes refrigeration in the heat exchanger to the first portion to effect the condensation, and the resulting second portion is not passed into the cryogenic rectification plant but rather is returned to the recycle compressor.

14 Claims, 2 Drawing Sheets

METHOD FOR PROVIDING REFRIGERATION TO A CRYOGENIC RECTIFICATION PLANT

TECHNICAL FIELD

This invention relates generally to the operation of cryogenic rectification plants, such as cryogenic air separation plants, and more particularly to the provision of refrigeration to a cryogenic rectification plant.

BACKGROUND ART

Cryogenic rectification processes often require substantial variation in the amount of refrigeration generated and provided to the plant. The ability to efficiently manipulate refrigeration generation improves the ability of the cryogenic rectification plant to vary liquid production at minimal power expenditure.

Typically the refrigeration for the system is generated by turboexpansion of a process stream which is then passed into the plant. Varying the amount of refrigeration generated in such a system is inefficient because turboexpansion efficiency decreases substantially as operating conditions vary from design conditions, thus limiting the degree to which the refrigeration may be varied. Other attempts to vary the refrigeration generated and provided by a cryogenic rectification plant include the use of variable nozzle turboexpanders, which have a limited operating range, the independent generation of refrigeration, which is capital intensive and expensive, and the use of integrated closed loop refrigeration generation systems, which have operating problems such as leakage.

Accordingly, it is an object of this invention to provide an improved method for providing refrigeration to a cryogenic rectification plant.

It is another object of this invention to provide an improved method for providing refrigeration to a cryogenic rectification plant which enables the facile provision of varying amounts of refrigeration to the cryogenic rectification plant.

SUMMARY OF THE INVENTION

The above and other objects, which will become apparent to those skilled in the art upon a reading of this disclosure, are attained by the present invention which is:

A method for providing refrigeration to a cryogenic rectification plant having at least one column comprising:

(A) compressing a working fluid in a recycle compressor to produce pressurized working fluid;

(B) passing a first portion of the pressurized working fluid to a heat exchanger and at least partially condensing said first portion in said heat exchanger to produce liquid working fluid first portion;

(C) cooling a second portion of the pressurized working fluid, turboexpanding the cooled second portion to generate refrigeration, passing the refrigeration bearing second portion to the heat exchanger, and providing refrigeration from the second portion to said first portion to effect the at least partial condensation of the first portion;

(D) passing the liquid working fluid first portion into a column of the cryogenic rectification plant; and (E) passing the second portion of the working fluid from the heat exchanger to the recycle compressor.

As used herein the term "feed air" means a mixture comprising primarily oxygen, nitrogen and argon, such as ambient air.

As used herein the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process*. The term "double column" is used to mean a higher pressure column having its upper end in heat exchange relation with the lower end of a lower pressure column.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein the term "indirect heat exchange" means the bringing of two fluids into heat exchange relation without any physical contact or intermixing of the fluids with each other.

As used herein the term "top condenser" means a heat exchange device that generates column downflow liquid from column vapor.

As used herein the term "bottom reboiler" means a heat exchange device that generates column upflow vapor from column liquid.

As used herein the terms "turboexpansion" and "turboexpander" mean respectively method and apparatus for the flow of high pressure gas through a turbine to reduce the pressure and the temperature of the gas thereby generating refrigeration.

As used herein the term "recycle compressor" means an apparatus, such as a mechanical compressor, that increases the pressure of a relatively low pressure working fluid, allowing it to be recirculated.

DETAILED DESCRIPTION

Figure 1:
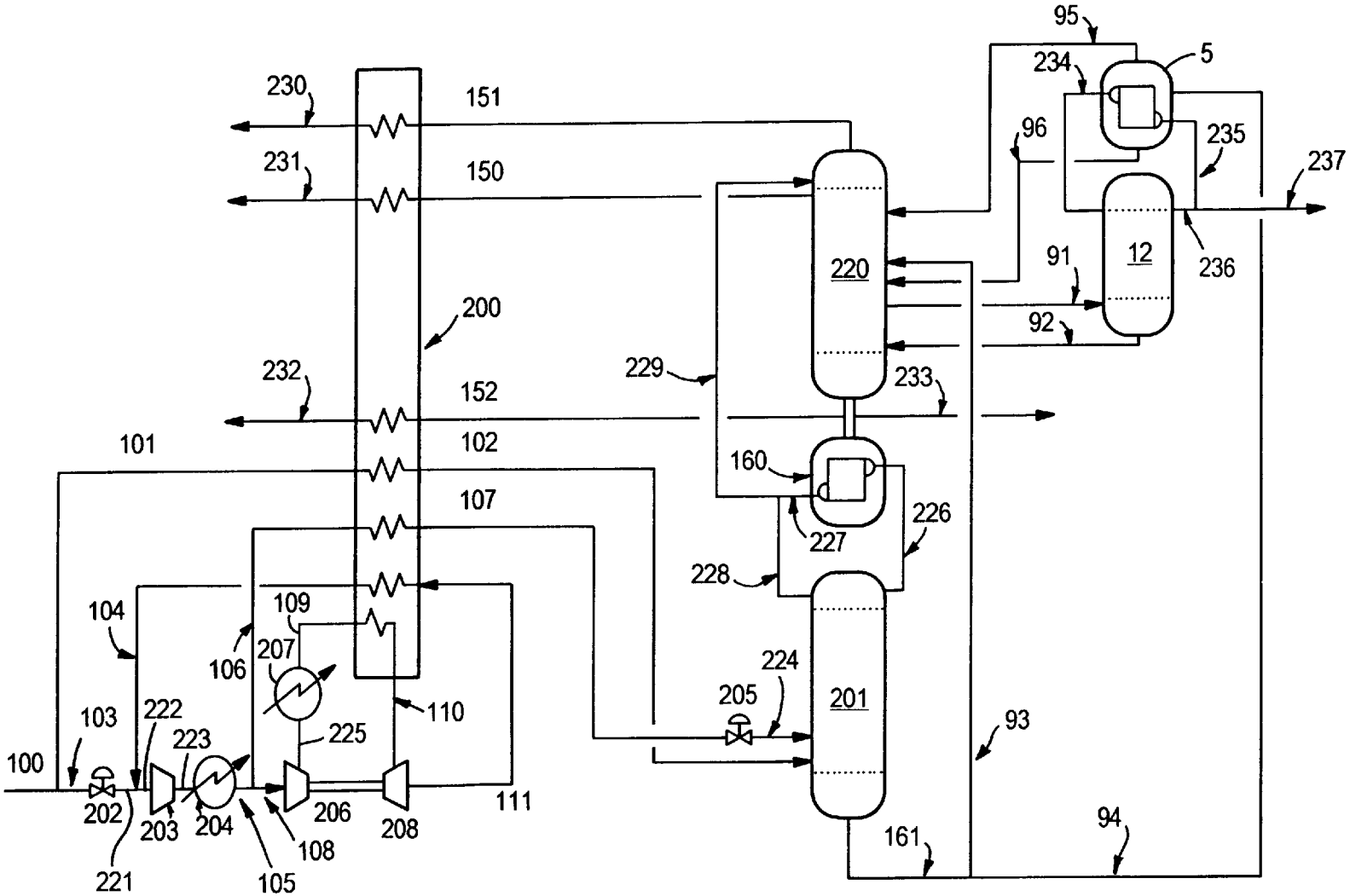
FIG. 1 is a schematic representation of one preferred embodiment of the invention wherein the working fluid is feed air and the cryogenic rectification plant is a cryogenic air separation plant comprising a double column and an argon sidearm column.

The invention is particularly useful for the operation of a cryogenic air separation plant and will be discussed in detail with respect to such plant. Any cryogenic air separation plant may be used in the practice of this invention including single column plants, double column plants and dual column plants as well as the plants illustrated in the Drawings.

The process of this invention enables the operator to manipulate the amount of refrigeration generated in an air separation process efficiently and at minimal added capital expenditure. This process employs a refrigeration generation means that is integrated with the air separation process and uses one of the separation process streams as the working fluid. The working fluid, which could be, for example, feed air, shelf nitrogen or product nitrogen, is compressed in a recycle compressor and then split into two high-pressure streams. The first high-pressure stream is at least partially liquefied in a heat exchanger that is also employed in the air separation process, such as the primary heat exchanger or the product boiler. The liquefaction pressure of the working fluid at the heat exchanger effluent temperature dictates the pressure associated with the first high-pressure stream. The resulting liquid stream is then fed to a distillation column. The second high-pressure stream is cooled to a temperature that is sub-ambient but greater than the fluid's dew point in the heat exchanger employed by the first high-pressure stream. The resulting cooled high-pressure stream is sent to a turboexpander, where its pressure is lowered to generate refrigeration. This stream is then warmed in the heat exchanger and then returned to the recycle compressor. Since the second high-pressure stream is not sent to the air separation process as it leaves the turboexpander, its pressure may be freely manipulated, and may even be lower than the pressures observed in the air separation process. New working fluid is added to the recycle loop to offset working fluid that is withdrawn and provided into the distillation column(s). This working fluid may be throttled into the refrigeration generation loop. As the process refrigeration requirement varies, the turboexpander discharge/recycle compressor feed pressure may be varied in combination with the mass of working fluid contained in the system to keep the actual volumetric flow rate of the turboexpander suction fixed. This allows the machinery to operate at its design point, maintaining high machinery efficiency, while allowing the amount of refrigeration generated to vary.

The invention will be described in greater detail with reference to the drawings. Referring now to FIG. 1, feed air 100, which has been cleaned of high boiling impurities such as carbon dioxide, water vapor and hydrocarbons, and has been compressed to a pressure generally within the range of from 50 to 300 pounds per square inch absolute (psia), is divided into at lease two portions. A first portion 101 is cooled by passage through primary heat exchanger 200 by indirect heat exchange with return streams and resulting cooled feed air stream 102 is passed into column 201 which is the higher pressure column of a double column which also includes lower pressure column 220.

A second portion 103 of feed air 100 is flashed across valve 202 where its pressure is lowered to the refrigeration generation system operating pressure which typically is within the range of from 14.7 to 200 psia. Resulting stream 221 is combined with working fluid recycle stream 104, which will be more fully described below, to form working fluid stream 222 which is passed to recycle compressor 203. Within recycle compressor 203 the working fluid is compressed to a pressure generally within the range of from 50 to 500 psia to produce pressurized working fluid 223. Preferably, as illustrated in FIG. 1, pressurized working fluid 223 is passed thorough aftercooler 204 emerging therefrom as pressurized working fluid 105.

A first portion 106 of the pressurized working fluid is passed to a heat exchanger wherein it is at least partially, and may be totally, condensed by indirect heat exchange with a refrigeration bearing second portion of the working fluid as will be more fully described below. First portion 106 typically comprises from 1 to 75 percent of the working fluid passed to and compressed in recycle compressor 203. In the embodiment of the invention illustrated in FIG. 1, the heat exchanger wherein first portion 106 is condensed is the primary heat exchanger 200 of the cryogenic rectification plant. However any other suitable heat exchanger of the cryogenic rectification plant may be used to effect the at least partial condensation of the first portion of the working fluid. Moreover, the heat exchanger could be a unitary piece or may comprise a plurality of modules. The liquid working fluid first portion is passed into a column of the cryogenic rectification plant. It may be all passed into one column or portions may be passed into different columns. In the embodiment of the invention illustrated in FIG. 1, liquid working fluid first portion in stream 107, which is liquid air, is flashed across valve 205 and passed as stream 224 in higher pressure column 201. Stream 224 may be entirely in the liquid phase or may be a two phase stream.

A second portion 108 of the pressurized working fluid, which typically compresses from 25 to 99 percent of the working fluid passed to and compressed in the recycle compressor, is cooled and then turboexpanded to generate refrigeration for the rectification plant. In the embodiment of the invention illustrated in FIG. 1, second portion 108 is passed to booster compressor 206 which is directly coupled to and driven by turboexpander 208. In booster compressor 206 the second portion of the working fluid is compressed to a pressure generally within the range of from 60 to 600 psia, and the resulting second portion 225 is cooled of the heat of compression in aftercooler 207. The resulting second portion 109 of the pressurized working fluid is then cooled to a temperature that is subambient but greater than that fluid's dew point in the same heat exchanger that is used to at least partially condense the first portion of the pressurized working fluid. The resulting cooled second portion 110 is turboexpanded by passage through turboexpander 208 to generate refrigeration, and the resulting refrigeration bearing second portion 111 is passed back to the heat exchanger wherein it is warmed thereby providing refrigeration by indirect heat exchange to the first portion of the working fluid to effect the at least partial condensation of the first portion. The refrigeration is then provided to the rectification plant column or columns by the passage of the liquid working fluid first portion into the column(s). The warmed second portion of the working fluid is then returned to the recycle compressor and the refrigeration cycle starts anew. In the embodiment of the invention illustrated in FIG. 1, warmed second portion 104 is passed from heat exchanger 200 and combined with feed air stream 221 to form stream 222 for passage to recycle compressor 203.

Higher pressure column 201 is operating at a pressure generally within the range of from 50 to 300 psia. Within higher pressure column 201 the feeds into that column are separated by cryogenic rectification into nitrogen-enriched vapor and oxygen-enriched liquid. Nitrogen-enriched vapor is withdrawn from the upper portion of higher pressure column 201 in stream 226 and condensed in main condenser 160 by indirect heat exchange with boiling oxygen-rich liquid which is lower pressure column 220 bottom liquid. A portion 228 of the resulting nitrogen-enriched liquid 227 is returned to column 201 as reflux. Another portion 229 of the nitrogen-enriched liquid 227 is passed into the upper portion of column 220 as reflux. If desired, a portion of stream 227 may be recovered as product liquid nitrogen.

Oxygen-enriched liquid is withdrawn from the lower portion of higher pressure column 221 in stream 161 and divided into portion 93 and portion 94. Portion 93 is passed into lower pressure column 220 and portion 94 is passed into argon column top condenser 5 wherein it is at least partially vaporized. The resulting vapor is withdrawn from condenser 5 in stream 95 and passed into lower pressure column 220. Any remaining oxygen-enriched liquid is withdrawn from condenser 5 and then passed in stream 96 into lower pressure column 220.

Lower pressure column 220 is operating at a pressure less than that of higher pressure column 201 and generally within the range of from 14.7 to 150 psia. Within lower pressure column 220 the various feeds into that column are separated by cryogenic rectification into nitrogen-rich vapor and oxygen-rich liquid. Nitrogen-rich vapor is withdrawn from the upper portion of column 220 in stream 151, warmed by passage through heat exchanger 200, and may be recovered as product gaseous nitrogen in stream 230 having a nitrogen concentration of at least 99 mole percent, preferably at least 99.9 mole percent, and most preferably at least 99.999 mole percent. For product purity control purposes a waste stream 150 is withdrawn from column 220 from a level below the withdrawal point of stream 151, warmed by passage through heat exchanger 200, and removed from the system in stream 231. Oxygen-rich liquid is partially vaporized by indirect heat exchange with condensing nitrogen-enriched vapor in main condenser 160 as was previously described to provide vapor upflow for column 220. If desired, a portion of the resulting oxygen-rich vapor may be withdrawn in stream 152 having an oxygen concentration generally within the range of from 90 to 99.9 mole percent. Oxygen-rich liquid may be withdrawn in stream 233 and recovered as product liquid oxygen.

Fluid comprising oxygen and argon is passed in stream 91 from lower pressure column 220 into third or argon column 12 wherein it is separated by cryogenic rectification into argon-richer fluid and oxygen-richer fluid. Oxygen-richer fluid is passed from the lower portion of column 12 in stream 92 into lower pressure column 220. Argon-richer fluid is passed in stream 234 from the upper portion of column 12 as vapor into argon column top condenser 5 wherein it is condensed by indirect heat exchange with the aforesaid oxygen-enriched liquid. Resulting argon-richer liquid is withdrawn from condenser 5 in stream 235. At least a portion 236 of the argon-richer liquid is passed into argon column 12 as reflux and, if desired, another portion is recovered as product liquid argon as shown by stream 237.

Figure 2:
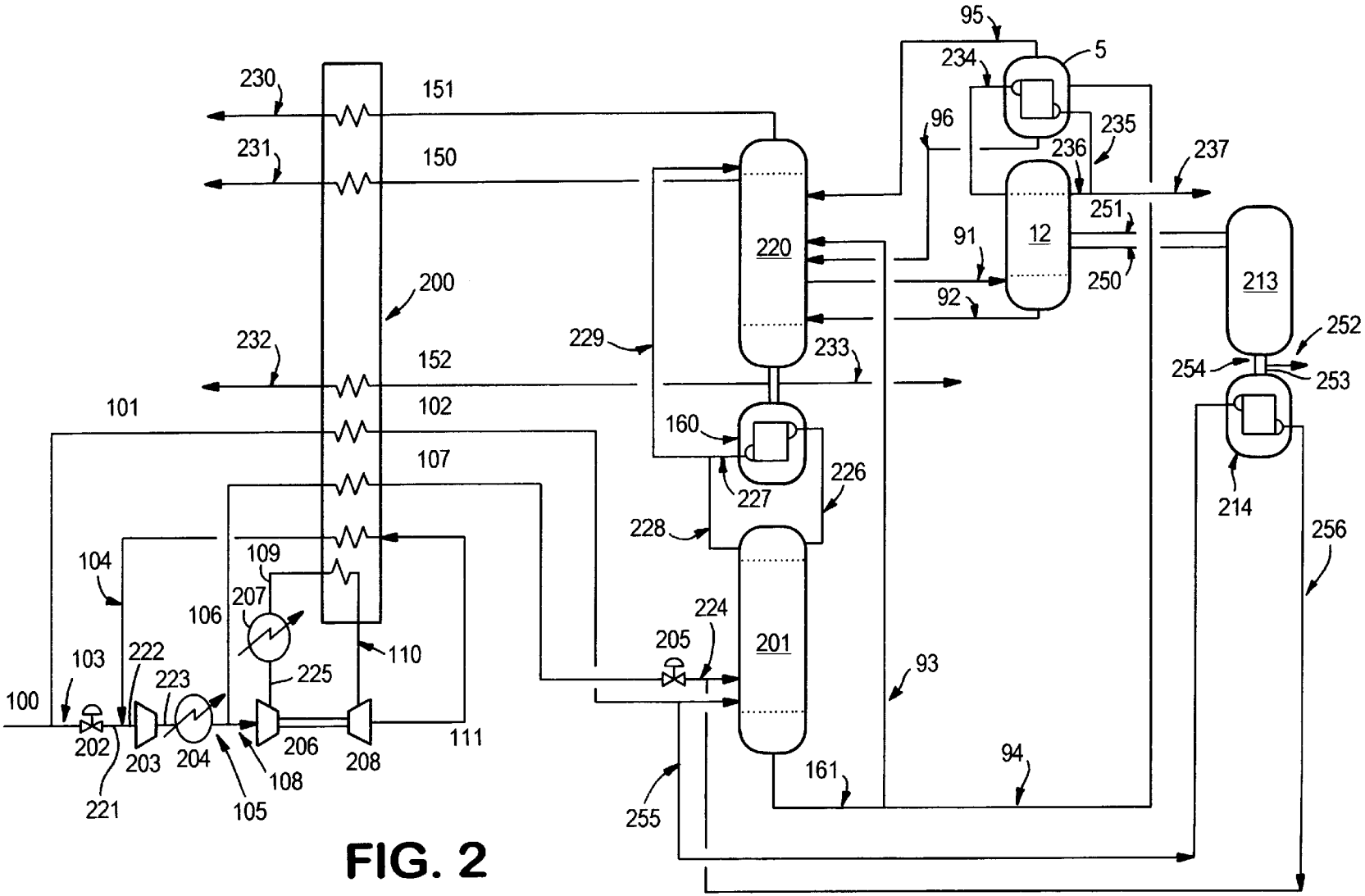
FIG. 2 is a schematic representation of another preferred embodiment of the invention wherein the working fluid is feed air and the cryogenic rectification plant is a cryogenic air separation plant comprising a double column, an argon sidearm column and an ultra high purity oxygen column.

FIG. 2 illustrates another embodiment of the invention wherein the cryogenic rectification plant is a cryogenic air separation plant which also produces ultra high purity oxygen. The numerals in FIG. 2 are the same as those in FIG. 1 for the common elements and these common elements will not be described again in detail.

Referring now to FIG. 2 a stream 250 comprising oxygen and argon is passed from argon column 12 into ultra high purity column 213 wherein it is separated by cryogenic rectification into ultra high purity oxygen liquid and argon/oxygen vapor which is passed to argon column 12 in stream 251. A portion of the ultra high purity oxygen liquid is recovered in product stream 252 having an oxygen concentration of at least 99 mole percent. Another portion of the ultra high purity oxygen liquid is passed in stream 253 to bottom reboiler 214 wherein it is vaporized and passed in stream 254 to provide vapor upflow for column 213. A portion 255 of feed air stream 102 is passed to reboiler 214 wherein it is condensed to effect the vaporization of the ultra high purity oxygen liquid. The resulting condensed feed air is withdrawn from bottom reboiler 214 in stream 256 and passed into higher pressure column 201, preferably, as illustrated in FIG. 2, combined with stream 224.

Although the invention has been described in detail with reference to certain preferred embodiments, those skilled in the art will recognize that there are other embodiments of the invention within the spirit and the scope of the claims.

What is claimed is:

1. A method for providing refrigeration to a cryogenic rectification plant having at least one column comprising:

(A) compressing a working fluid in a recycle compressor to produce pressurized working fluid;

(B) passing a first portion of the pressurized working fluid to a heat exchanger and at least partially condensing said first portion in said heat exchanger to produce liquid working fluid first portion;

(C) cooling a second portion of the pressurized working fluid, turboexpanding the cooled second portion to generate refrigeration, passing the refrigeration bearing second portion to the heat exchanger, and providing refrigeration from the second portion to said first portion to effect the at least partial condensation of the first portion;

(D) passing the liquid working fluid first portion into a column of the cryogenic rectification plant; and (E) passing the second portion of the working fluid from the heat exchanger to the recycle compressor and wherein the second portion of the pressurized working fluid is compressed to a higher pressure prior to being cooled.

2. The method of claim 1 wherein the cryogenic rectification plant has a primary heat exchanger and the heat exchanger wherein the first portion of the working fluid is at least partially condensed is the primary heat exchanger.

3. The method of claim 1 wherein the compression of the second portion of the pressurized working fluid is carried out by passage through a booster compressor which is driven by the turboexpansion of the cooled second portion of the working fluid.

4. The method of claim 1 wherein the cryogenic rectification plant is a cryogenic air separation plant.

5. The method of claim 4 wherein the working fluid is feed air.

6. The method of claim 4 whereon the cryogenic air separation plant comprises a plurality of columns.

7. The method of claim 6 wherein the cryogenic air separation plant comprises a double column having a higher pressure column and a lower pressure column.

8. The method of claim 7 wherein the liquid working fluid first portion is passed into the higher pressure column.

9. The method of claim 8 wherein fluid is passed from the higher pressure column to the lower pressure column and wherein at least one of product nitrogen and product oxygen is recovered from the lower pressure column.

10. The method of claim 9 further comprising passing fluid from the lower pressure column into an argon sidearm column and recovering product argon from the argon sidearm column.

11. The method of claim 10 further comprising passing fluid from the argon sidearm column into an ultra high purity column and recovering product ultra high purity oxygen from the ultra high purity column.

12. The method of claim 1 wherein the first portion of the pressurized working fluid is totally condensed in the heat exchanger.

13. The method of claim 1 wherein the liquid working fluid first portion is reduced in pressure prior to being passed into a column of the cryogenic rectification plant.

14. The method of claim 1 wherein the cryogenic rectification plant comprises a plurality of columns and the liquid working fluid first portion is passed only into one column of the cryogenic rectification plant.

* * * * *